US005283162A

United States Patent [19]

Kapp et al.

[11] Patent Number: 5,283,162

[45] Date of Patent: Feb. 1, 1994

[54] PHOTOGRAPHIC ELEMENTS CONTAINING SULFITE RELEASABLE RELEASE COMPOUNDS

[75] Inventors: Daniel L. Kapp; Wojciech Slusarek; David T. Southby, all of Rochester, N.Y.

[73] Assignee: Eastman Kodak Company, Rochester, N.Y.

[21] Appl. No.: 890,987

[22] Filed: May 29, 1992

[51] Int. Cl.[5] ..... G03C 5/54; G03C 7/32; G03C 5/26; G03C 1/06

[52] U.S. Cl. ..... 430/382; 430/202; 430/222; 430/223; 430/226; 430/445; 430/446; 430/434; 430/448; 430/543; 430/544; 430/564; 430/566; 430/611; 430/512; 430/559; 430/955; 430/957; 430/958; 430/959

[58] Field of Search ..... 430/202, 222, 223, 226, 430/544, 955, 958, 959, 957, 382, 434, 445, 543, 446, 448, 564, 566, 611, 512, 559

[56] References Cited

U.S. PATENT DOCUMENTS

| | | | |
|---|---|---|---|
| 4,248,962 | 2/1981 | Lau | 430/382 |
| 4,409,323 | 10/1983 | Sato et al. | 430/544 |
| 4,684,604 | 8/1987 | Harder | 430/375 |
| 4,871,654 | 10/1989 | Van Maele et al. | 430/955 |
| 5,034,311 | 7/1991 | Slusarek et al. | 430/544 |
| 5,055,385 | 10/1991 | Slusarek et al. | 430/544 |
| 5,116,712 | 5/1992 | Matsushita et al. | 430/958 |

FOREIGN PATENT DOCUMENTS 0167168 11/1989 European Pat. Off. .

*Primary Examiner*—Richard L. Schilling
*Attorney, Agent, or Firm*—Peter C. Cody

[57] ABSTRACT

There are described photographic elements containing novel release compounds which release a blocked photographically useful group, such as a blocked development inhibitor. The blocking group is removed during processing as a result of reaction with sulfite ion contained in one of the processing baths.

10 Claims, No Drawings

PHOTOGRAPHIC ELEMENTS CONTAINING SULFITE RELEASABLE RELEASE COMPOUNDS

FIELD OF THE INVENTION

This invention relates to silver halide photographic elements containing novel release compounds and to processes of forming images in such photographic elements. In a particular aspect, it relates to elements and processes in which the release compound is activated as a result of reaction with a component of one of the processing compositions.

BACKGROUND OF THE INVENTION

Images are formed in silver halide color photographic materials by reaction between oxidized silver halide developing agent and a dye forming compound known as a coupler. It has become common practice to modify the photographic properties of the image, such as sharpness, granularity, contrast and color reproduction, by the use of an image modifying compound commonly referred to as a development inhibitor releasing (DIR) compound. Such materials were first described in U.S. Pat. Nos. 3,148,062 and 3,227,554.

More recently, U.S. Pat. Nos. 4,248,962; 4,409,323; 4,684,604; 5,034,311; and 5,055,385; and European Patent Application 0 167 168 have described release compounds from which a development inhibitor, or another photographically useful group, is released from an intervening group, called a timing group, after that group is released from the carrier portion of the compound. The use of a timing group provides a way to separate the release function from the carrier function and permits these separate functions to be separately designed into the compound.

In addition to development inhibitors, other photographically useful groups may desirably be released during photographic processing. Such groups include development accelerators, bleach accelerators, bleach inhibitors, complexing agents, toners, stabilizers, etc. Photographically useful groups typically are released during the development step in an imagewise manner. On occasion, depending upon the particular photographically useful group and the purpose it is to serve, it may be desired to release the group, in its active form, at a stage in the processing of the photographic element other than the development step, or in a uniform manner, or both.

A problem with the known release compounds is that the known timing groups are required to have high enough electron density to release the photographically useful group through either an intramolecular nucleophilic reaction or via an intramolecular electron migration. This requirement limits the choice of carrier groups to those whose pKa's are low enough to compensate for the high electron density of the timing group.

It would be desirable to provide release compounds which allow independent choice both of the photographically useful group and of the carrier group from which it is released. In addition it is desirable to have the release of the photographically useful group occur only when the timing group has been released from the carrier. Likewise, it is desirable to have the release of the photographically useful group not require an additional oxidation step.

SUMMARY OF THE INVENTION

We have found that this can be accomplished with a photographic element comprising a support bearing a silver halide emulsion layer having associated therewith a release compound comprising a carrier group from which is released a photographically useful group, the active function of which is blocked with an aromatic nucleus which is unsubstituted or substituted with one or more electron withdrawing groups, the blocking group being capable of being removed during processing as a result of reaction with sulfite ion in a processing bath.

This photographic element, after it has been exposed to an imagewise pattern of actinic radiation, is processed in a processing composition containing sufficient sulfite ion to cause cleavage of the aromatic group from the inhibitor after the aromatic group has been cleaved from the carrier and any timing group present. This results in release of the photographically useful group in its active form and consequent modification of the photographic image.

DETAILED DESCRIPTION

In a preferred embodiment, the release compound of this invention can be represented by the structure:

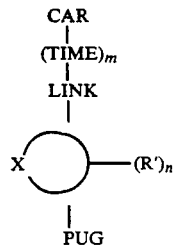

I.

wherein:

CAR is a carrier group from which the remainder of the molecule is released during photographic processing;

TIME is a timing group;

LINK is a linking group which joins TIME or CAR to the aromatic nucleus;

X represents the atoms to complete an aromatic ring or ring system;

R' represents an electron withdrawing substituent;

PUG represents a photographically useful group;

m is 0, 1 or 2; and n is an integer of 0 to 8.

The carrier group, represented by CAR in the above structures, can be a blocking group formed from a silyl group or from a carboxylic, sulfonic, phosphonic, or phosphoric acid derivative which is cleaved from the remainder of the molecule in a non-imagewise manner by hydrolysis. Such a preferred blocking group is described in Buchanan et al. U.S. Pat. No. 5,019,492.

CAR can be an oxidizable moiety, such as a hydrazide or hydroquinone derivative, which releases the remainder of the molecule in an imagewise manner as a function of silver halide development. Such blocking groups are described, for example, in U.S. Pat. Nos. 3,379,529 and 4,684,604.

In a preferred embodiment of this invention, CAR is a coupler moiety to whose coupling position the remainder of the molecule is attached, so that it is coupled off by reaction with oxidized color developing agent formed in an imagewise manner as a function of silver halide development.

When CAR is divalent, multivalent, or polymeric, it is capable of releasing more than one photographically useful group. To immobilize the release compound when it is incorporated in a photographic element, a ballast group may be attached to one or both of CAR or TIME.

X represents the atoms selected from carbon, nitrogen, boron, and phosphorus to complete an aromatic ring system composed of one, two or three 5-, 6- or 7-membered rings; rings completed by X include benzene, naphthalene, anthracene, pyridine, pyrimidine, pyrazine, purine, quinoline, acridine and isoquinoline. (It will be appreciated that the aromatic ring system in the blocking group includes heteroaromatic ring systems.)

The electron withdrawing groups represented by R′ include nitro, cyano, fluoro, fluoroalkyl, fluorosulfonyl, fluoroalkylsulfonyl, sulfonamido, aminosulfonyl, alkylsulfonyl, arylsulfonyl, alkylcarbonyl, arylcarbonyl, and the like.

Representative LINK groups are selected from esters, amides, sulfones, ethers and thioethers and include the following structures, where the left side of the group is joined to TIME and the right side of the group is joined to the aromatic nucleus:

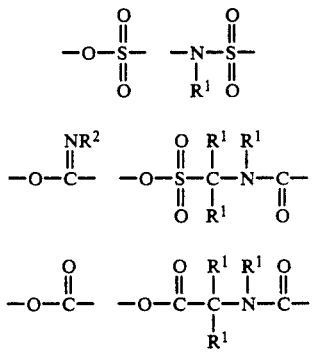

where:

$R^1$ is H, alkyl or aryl and $R^2$ is $COR^1$ or $SO_2R^1$.

In the structures shown herein, the alkyl group and the alkyl portions of alkyl-containing substituents can contain up to 20 carbon atoms and the carbon chain can be substituted with heteroatoms and can further be substituted with such groups as halogen, carboxy, amido, sulfonamido, and the like. In instances where bulk is not desired or is detrimental, the alkyl group contains 1 to 4 carbon atoms. Aryl groups and the aryl portion of aryl containing substituents include aryl groups of 6 to 20 carbon atoms, such as phenyl, naphthyl and anthracyl which can be unsubstituted or substituted with substituents as described above for the alkyl group, or with alkyl groups. Representative heterocyclic groups include pyridyl, quinolyl, pyrazolyl, furanoyl, thiophenyl, and the like.

In the above structure, the group represented by TIME, if present, can be any of the known timing groups. Representative timing groups are described in the patents discussed above. They include groups which release the remainder of the molecule by an intramolecular nucleophilic displacement reaction, such as a carbamate timing group as described in U.S. Pat. No. 4,248,962, and groups which release the remainder of the molecule by electron transfer along a conjugated system such as a quinone methide timing r group as described in U.S. Pat. No. 4,409,323 and similar groups as described in U.S. Pat. Nos. 5,034,311 and 5,055,385. The TIME group can contain one or more timing groups, so as to provide a double, or multiple, switch timing group as described in Burns and Taber U.S. Pat. No. 4,861,701.

The photographically useful group, represented by PUG can be any group usefully made available during photographic processing. Included are dyes and dye precursors, such as a sensitizing dye, filter dye, image dye, leuco dye, blocked dye, shifted dye, or an ultraviolet light absorber. Also included are photographic reagents, which upon release can further react with components in the element. Such reagents include development accelerators, development inhibitors, bleach accelerators, bleach inhibitors, couplers (e.g. competing couplers, color-forming couplers, or DIR couplers), developing agents (e.g. competing developing agents or auxiliary developing agents), silver complexing agents, fixing agents, toners, hardeners, tanning agents, fogging agents, antifoggants, antistain agents, stabilizers, and nucleophiles and dinucleophiles.

PUG is preferably a development inhibitor, such as a mercaptotetrazole or a benzotriazole inhibitor.

A preferred group of release compounds of this invention can be represented by the structure:

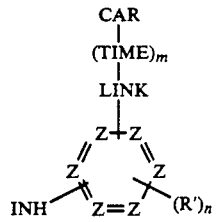

II.

wherein:

CAR, TIME, LINK and R′ are as defined above;

m is 0 or 1;

n is 0, 1 or 2;

Z is CH or N, no more than 3 Z's being N; and

INH is a development inhibitor group.

A particularly preferred class of release compound of this invention can be represented by the structure:

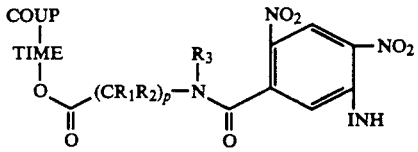

III.

wherein:

COUP is a coupler moiety having the remainder of the molecule joined to its coupling position;

TIME is a quinone methide timing group;

INH is a development inhibitor group;

$R_1$, $R_2$, and $R_3$ are hydrogen, alkyl, or aryl groups; and p is an integer of 1 to 8.

Representative couplers of this invention include:

(1)
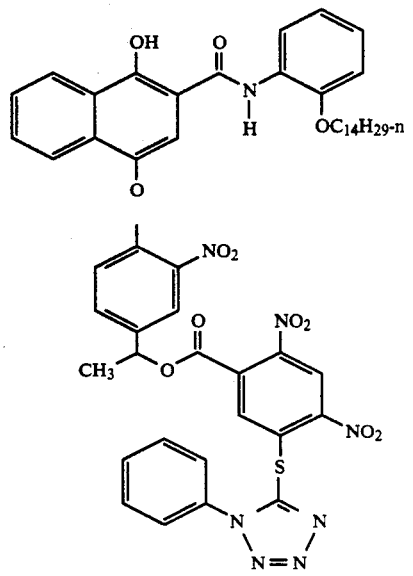
(2)
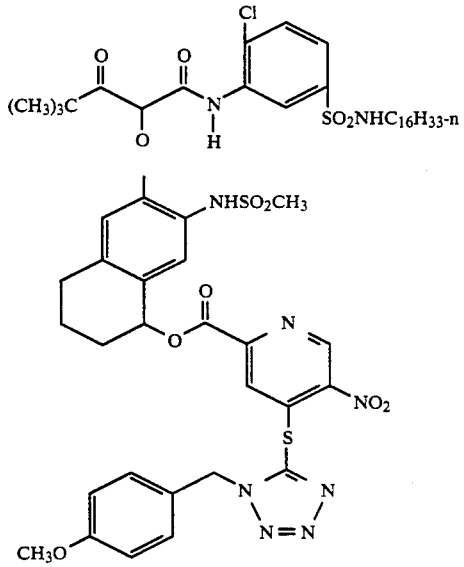
(3)
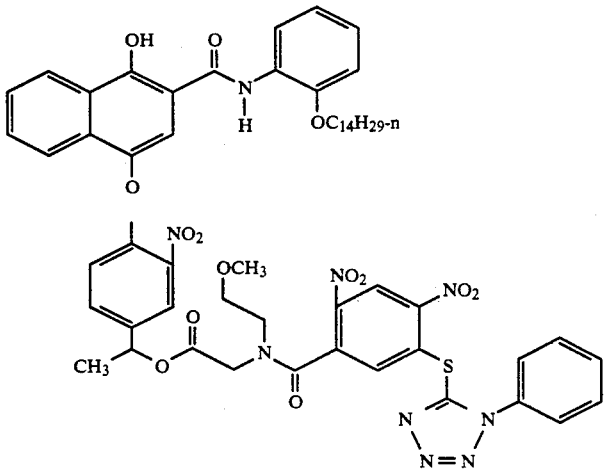

-continued
(4)
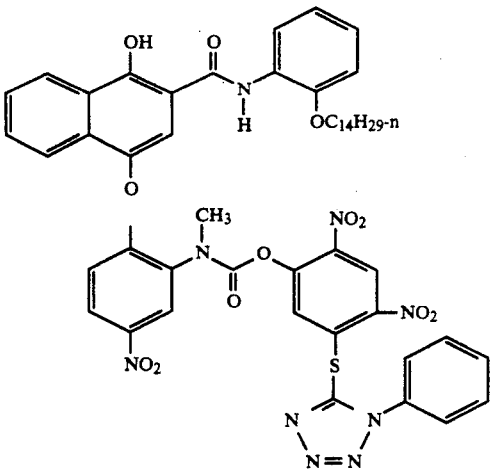
(5)
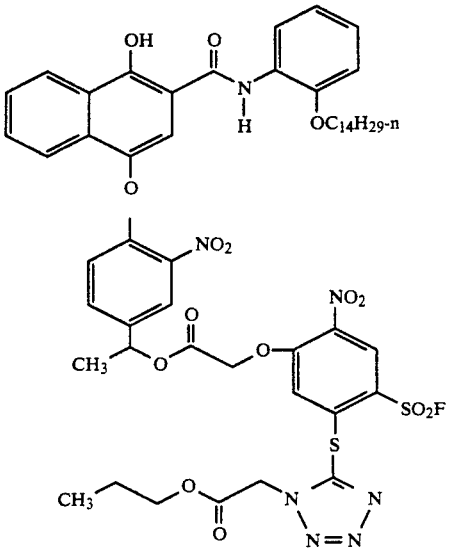
(6)
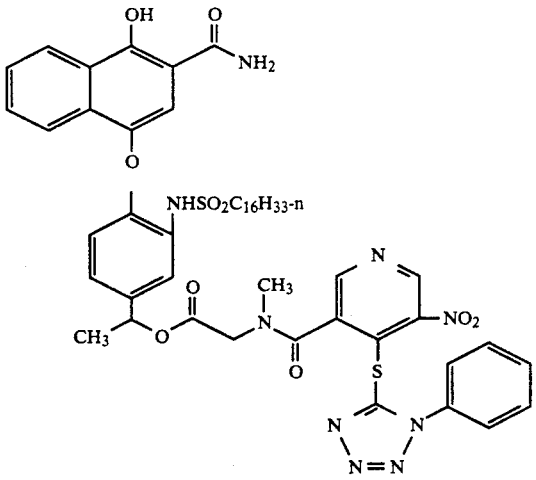
(7)
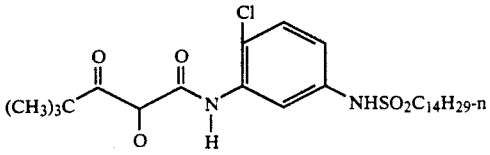

-continued
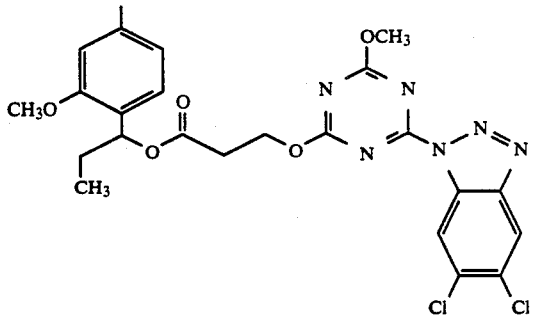
(8)
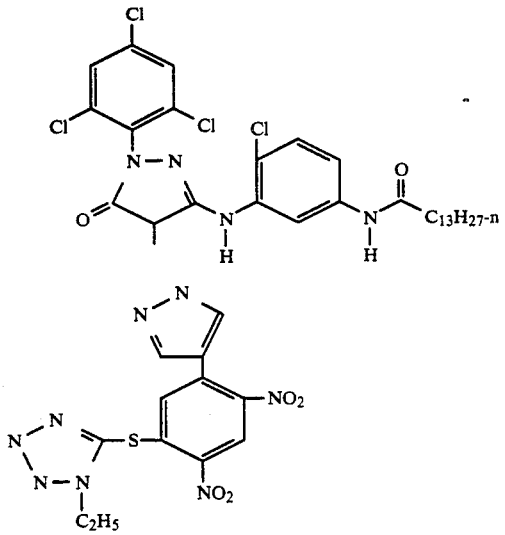
(9)
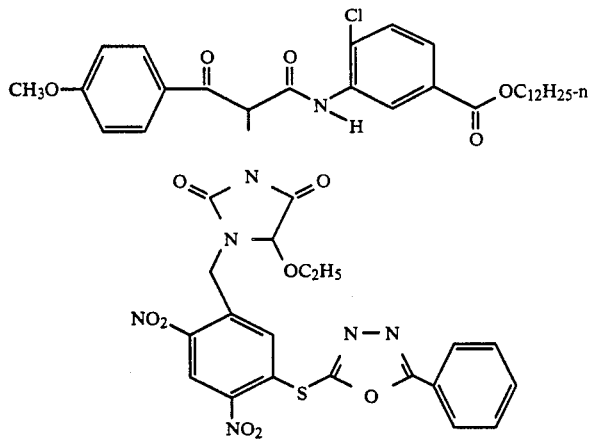
(10)
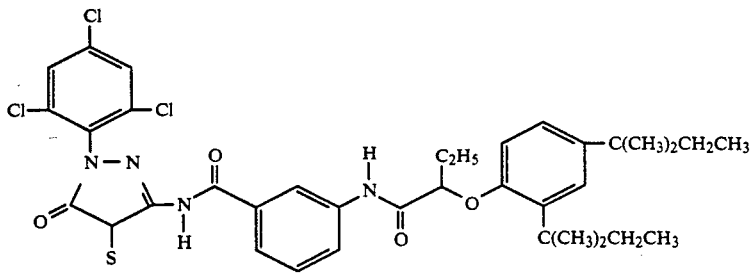

-continued

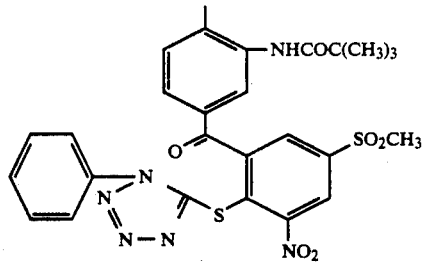

The novel compounds employed in this invention can be prepared by synthetic procedures well known in the art. Generally, this involves first the preparation of an appropriate precursor of the timing group followed by its attachment to the coupler. Next, the inhibitor-bearing aromatic moiety is connected to the timing group via the necessary link to complete the synthesis. A representative synthesis is shown below.

EXAMPLE 1

Preparation of Compound (1)

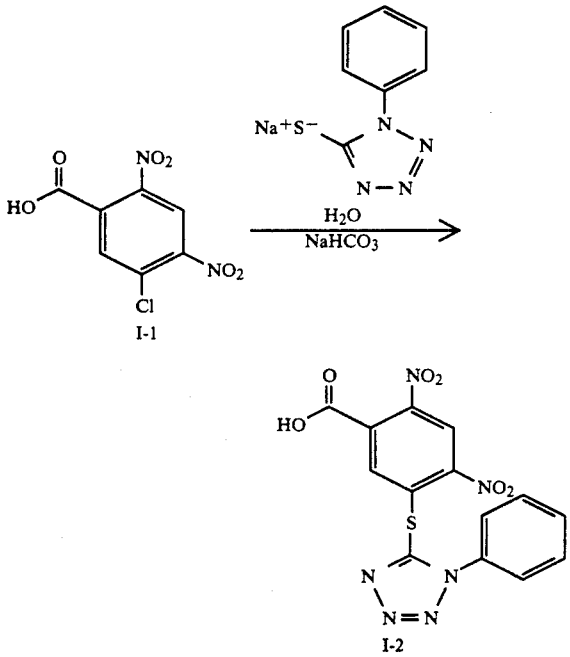

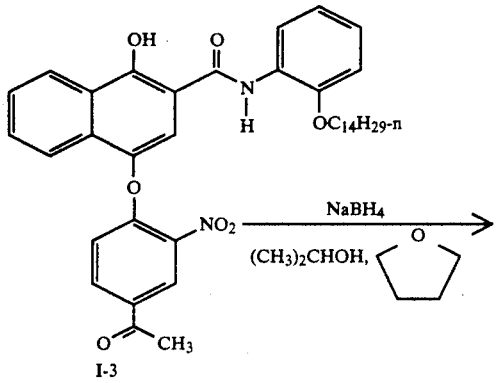

-continued

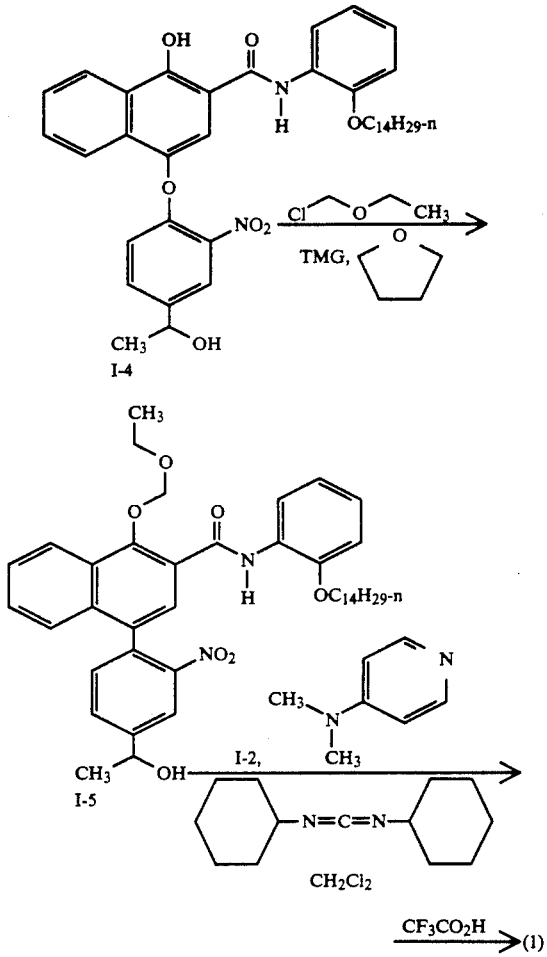

Preparation of Compounds I-2

Solid sodium bicarbonate (33.6 g; 400 mmole) was added in small portions to a slurry of 3-chloro-4,6-dinitrobenzoic acid (I-1) (24.7 g; 100 mmole) and sodium salt of 1-phenyl-1H-tetrazole-5-thiol (24.0 g; 120 mmole) in 500 ml of water. The mixture was then stirred at 60° C. for 24 h, neutralized and extracted with ethyl acetate. The extracts were dried over magnesium sulfate and concentrated in vacuo giving solid I-2. Yield 36.4 g (94 mmole; 94%)

Preparation of Compound I-4

Solid sodium borohydride (3.1 g; 81 mmole) was added in small portions at 5° C. to a solution of I-3 (40.3 g; 62 mmole) in 800 ml of isopropanol and tetrahydrofuran (1:1). The mixture was stirred for 30 min. and poured onto ice/conc. hydrochloric acid. After 3 hours the mixture was filtered, collected solid washed with water and dried in vacuo. Yield 40.4 g (62 mmole; 100%).

Preparation of Compound I-5

Neat tetramethylguanidine (1.7 g; 15 mmole) was added in drops at room temperature to a solution of I-4 (9.9 g; 15 mmole) in 75 ml of tetrahydrofuran, followed by chloromethyl ethyl ether (1.4 g; 15 mmole). After stirring for 2 h the mixture was filtered. The filtrate was concentrated and the residue crystallized from heptane. Yield 10.2 g (14 mmole; 95%).

Preparation of Compound (1)

A solution of dicyclohexyl carbodiimide (2.3 g; 11 mmole) in 15 ml of dichloromethane was added in drops at 0° C. to a solution of I-5 (7.2 g; 10 mmole), I-2 (3.9 g; 10 mmole), and 4-dimethylaminopyridine (0.12 g; mmole) in 70 ml of dichloromethane. The mixture was stirred at room temperature for 2 h and filtered. Trifluoroacetic acid (5 ml) was added to the filtrate and after 10 min. the solution was taken to dryness and the residue purified by chromatography. Yield 4.4 g (4.3 mmole; 43%) of Compound (1).

Calculated for $C_{53}H_{54}N_8O_{12}S$: % C-61.98; % H-5.30; % N-10.91; % S-3.12, Found: % C-61/63; % H-5.22; % N-10.66; % S-3.11, The photographic elements can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure". The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The release compounds can be used and incorporated in photographic elements in the way that such compounds have been used in the past. Depending upon the nature of the particular photographically useful group, the release compound can be incorporated in a photographic element for different purposes and in different locations and these elements can contain various other components. Reference will be made to exemplary ways in which preferred photographically useful groups can be incorporated.

When the photographically useful group released is a development inhibitor, it can be employed in a photographic element as described, for example, in U.S. Pat. No. 3,227,554; 3,620,747; 3,703,375; 4,248,962 and 4,409,323. Compounds of this invention which release a development inhibitor can be contained in, or in reactive association with, one or more of the silver halide emulsion units in a color photographic element. If the silver halide emulsion unit is composed of more than one layer, one or more of such layers can contain the compound of this invention. The layers can contain photographic couplers conventionally used in the art. The couplers of this invention can form dyes of the same color as the color forming coupler(s) in the layer or unit, it can form a dye of a different color, or it can result in a colorless or neutral reaction product. The range of operation of the development inhibitor between layers when released from the coupler of this invention can be controlled by the use of scavenger layers, such as a layer of a fine grain silver halide emulsion. Scavenger layers can be in various locations in an element containing couplers of this invention. They can be located between layers, between the layers and the support, or over all of the layers.

Release compounds of this invention which release bleach inhibitors can be employed in the ways described in U.S. Pat. No. 3,705,801, to inhibit the bleaching of silver in selected areas of a photographic element.

Release compounds of this invention which release bleach accelerators can be employed to accelerate the bleaching of silver in the photographic element.

Release compounds of this invention which release a dye or dye precursor can be used in processes where the dye is allowed to diffuse to an integral or separate receiving layer to form a desired image as described for example in U.S. Pat. Nos. 3,227,551; 3,443,940 and 3,751,406. Alternatively, the dye can be retained in the location where it is released to augment the density of the dye formed from the coupler from which it is released or to modify or correct the hue of that dye or another dye. In another embodiment, the released dye can be completely removed from the element and the released dye which was not released from the coupler can be retained in the element as a color correcting mask.

Release compounds of this invention in which the photographically useful group is a coupler can be employed to release another coupler. If the released coupler is a dye-forming coupler it can react with oxidized developing agent in the same or an adjacent layer to form a dye of the same or a different color or hue as that obtained from the primary coupler. If the released coupler is a competing coupler it can react with oxidized color developing agent in the same or an adjacent layer to reduce dye density.

Release compounds of this invention in which the photographically useful group is a developing agent can be used to release a developing agent which will compete with the color forming developing agent, and thus reduce dye density. Alternatively, they can provide, in an imagewise manner, a developing agent which because of such considerations as activity would not desirably be introduced into the element in a uniform fashion.

Release compounds of this invention in which the photographically useful group is a nucleating agent, can be used to accelerate development.

The photographic elements of this invention can be exposed to actinic radiation, typically in the visible region of the spectrum, to form a latent image, as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Sulfite ion is typically present in developer baths, fixing baths, conditioner baths, and/or bleach accelerator baths. A bath containing sulfite could be added to a process in order to activate the blocked photographically useful group, if necessary or desired.

Sulfite ion in processing solutions can come from salts of sulfite, such as sodium sulfite or potassium sulfite; salts of bisulfite such as sodium bisulfite, potassium bisulfite, or sodium formaldehyde bisulfite; or salts of metabisulfite, such as sodium metabisulfite or potassium metabusulfite. The concentration of sulfite or sulfite and bisulfite can be in the range 0.0001 to 1.0 molar, preferably in the range 0.01 to 1.0 molar.

The following examples further illustrate this invention.

EXAMPLES

Photographic elements were prepared by coating the following layers on a cellulose ester film support (the number following a component indicates the amount of the component contained in the layer, in mg/m$^2$)

Emulsion Layer 1:
- Gelatin - 2420;
- Red sensitized silverbromoidide (as Ag)-1615;
- Yellow image coupler dispersed in dibutyl phthalate-1290;

Interlayer;
- Gelatin-860;
- Didodecylhydroquinone-113

Emulsion Layer 2:
- Gelatin-2690;
- Green sensitized silver bromoiodide (as Ag)-1615;
- Cyan image coupler dispersed in dibutyl phthalate-768;
- of Table 1 dispersed in diethyl lauramide;

Protective Overcoat:
- Gelatin-5380;
- Bisvinylsulfonylmethyl ether at 1.75–2% total gelatin.

Structures of the image couplers are as follows.

Cyan Image Coupler:

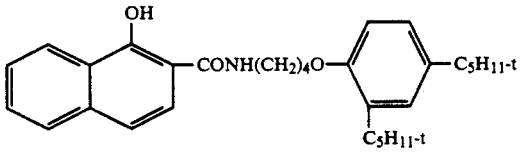

Yellow Image Coupler:

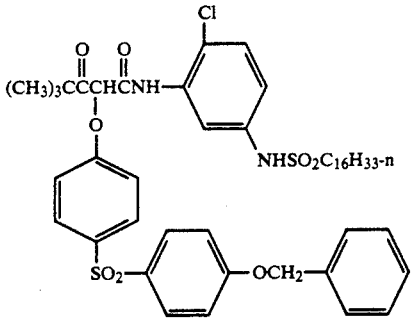

Strips of each element were exposed to green light through a graduated density step tablet, or through a 35% modulation fringe chart for sharpness measurements, and then developed 3.25 minutes at 38° C. in the following color developer, stopped, washed, bleached, fixed, washed and dried.

| Color Developer: | |
|---|---|
| Distilled water | 800 ml |
| Sodium Metabisulfite | 2.78 g |
| Sodium Sulfite, anhydrous | 0.38 g |
| CD-4 (color developer)* | 4.52 g |
| Potassium Carbonate, anhydrous | 34.3 g |
| Potassium Bicarbonate | 2.32 g |
| Sodium Bromide | 1.31 g |
| Potassium Iodide | 1.20 mg |
| Hydroxylamine Sulfate (HAS) | 2.41 g |
| Diethylenetriaminepentacetic acid, pentasodium salt (40% Soln.) | 8.43 g |
| Distilled water | to 1 L |

Adjust pH to 10.0

*CD-4 is 4-amino-3-methyl-N-ethyl-N-beta-hydroxy-ethylaniline sulfate.

Processed images were read with red light to determine contrast and AMT acutance. The acutance for a no development inhibitor releasing (DIR) compound containing coating was subtracted from each AMT value to provide the increase in sharpness value reported as the change in AMT in Table I. Contrast ratio was defined as the red contrast of a coating containing the coupler divided by the red contrast of a coating without the coupler. AMT accutance is a measure of the sharpness of the image and is calculated employing the following formula in which the cascaded area under the system modulation curve is shown in equation (21.104) on page 629 of the *Theory of the Photographic Process*, 4th edition, 1977, edited by T. H. James: AMT=100+66 Log [cascaded area/2.669M] wherein the magnification factor M is 3.8 for the 35 mm system AMT. These examples show that there is an improvement in sharpness (AMT) with the invention which is not attainable with structurally similar prior art inhibitors which are not released with the sulfite enhancement of this invention. The contrast ratios show that with prior art coupler A, inhibitor is released by does not lead to a sharpness enhancement because it does not have the ability to diffuse and that prior art coupler B does not release as much inhibitor.

TABLE I

| Coupler (mmoles/m$^2$) | Change in AMT | Contrast Ratio | |
|---|---|---|---|
| A (0.11) | +0.6 | 0.30 | Comparison |
| B (0.09) | +0.2 | 1.06 | Comparison |
| 3 (0.11) | +2.8 | 0.47 | Invention |

Coupler A

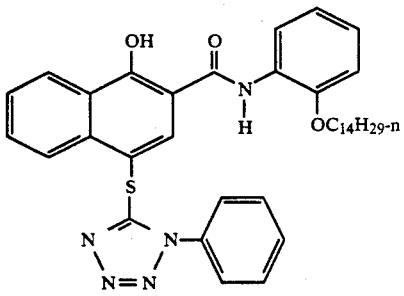

Coupler B

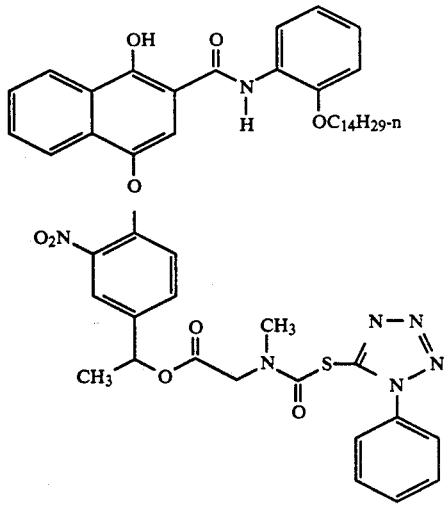

The invention has been described in detail with particular reference to preferred embodiments thereof, but it will be understood that variations and modifications can be effected within the spirit and scope of the invention.

What is claimed is:

1. A photographic element comprising a support bearing a silver halide emulsion layer having associated therewith a release compound comprising a carrier group from which a photographically useful group is released in an imagewise manner during photographic processing, the active function of the photographically useful group being a hetero atom which is blocked by direct attachment to an aromatic ring system which is substituted with one or more electron withdrawing groups, after release from the carrier the blocking group being capable of being removed during processing as a result of reaction with sulfite ion contained in a processing bath.

2. A photographic element of claim 1, wherein the release compound has the structure:

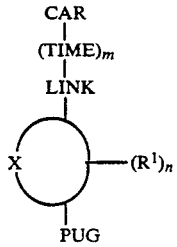

I.

wherein:

CAR is a carrier group from which the remainder of the molecule is released in an imagewise manner during photographic processing:

TIME is a timing group;

LINK is a linking group which joins TIME or CAR to the aromatic nucleus;

X represents the atoms to complete an aromatic ring system;

R' represents an electron withdrawing substituent;

PUG represents a photographically useful group having a heteroatom which is directly joined to the aromatic ring system comprising by X;

after release from CAR, the aromatic ring system completed by X being capable of being removed from PUG during processing as a result of reaction with sulfite ion contained in a processing bath;

m is 0, 1 or 2; and n is an integer of 1 to 8.

3. A photographic element comprising a support bearing a silver halide emulsion layer having associated therewith a release compound comprising a carrier group from which is released a photographically useful group, the active function of which is blocked with an aromatic ring system which is unsubstituted or substituted with one or more electron withdrawing groups, the blocking group being capable of being removed during processing as a result of reaction with sulfite ion in a processing bath; wherein the release compound has the structure;

II.

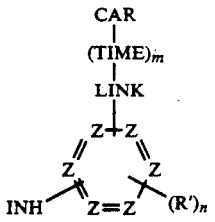

wherein:

CAR is a carrier group from which the remainder of the molecule is released during photographic film processing;

TIME is a timing group;

LINK is a linking group which joins TIME or CAR to the aromatic nucleus;

R' represents an electron withdrawing substituent m is 0 or 1;

n is 0, 1 or 2;

Z is CH or N, no more than 3 Z's being N; and

INH is a development inhibitor group.

4. A photographic element of claim 1, wherein the release compound has the structure;

III.

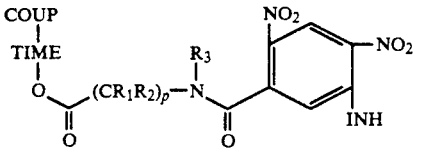

wherein:

COUP is a coupler moiety having the remainder of the molecule joined to its coupling position;

TIME is a quinone methide timing group; and

INH is a development inhibitor group, $R_1$, $R_2$, and $R_3$ are H, alkyl, or aryl groups p is an integer of 1 to 8.

5. A photographic element of claim 1, wherein the release compound has the structure:

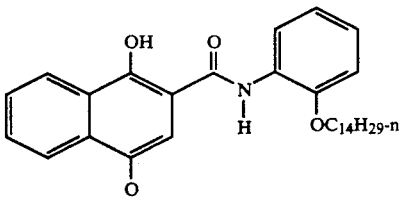

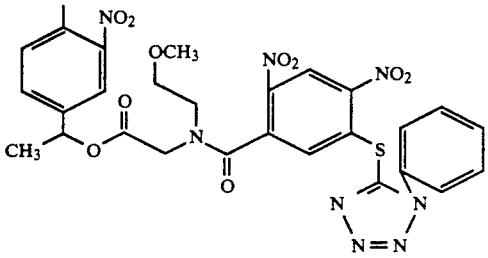

6. A photographic element of claim 1, wherein the release compound has the structure:

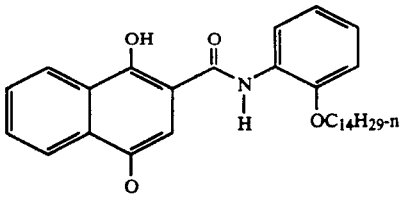

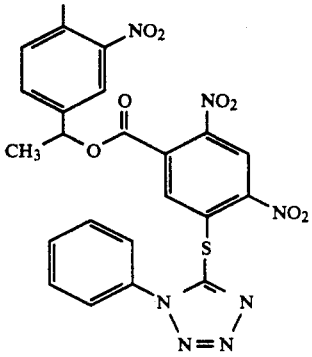

7. A photographic element of claim 1, wherein the release compound has the structure:

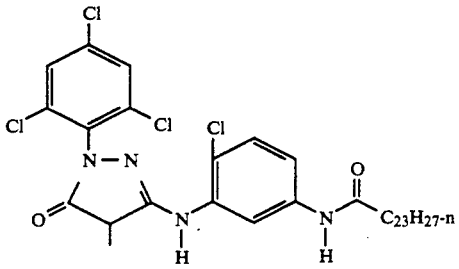

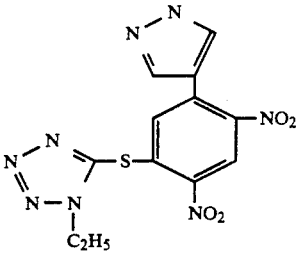

8. A photographic element of claim 1, wherein the release compound has the structure:

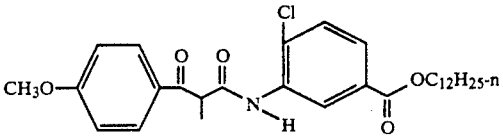

-continued

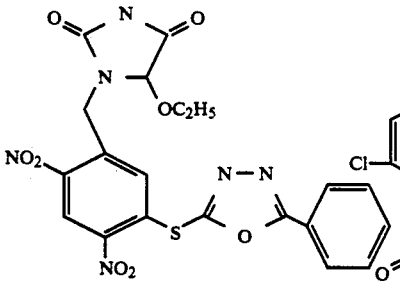

9. A photographic element of claim 1, wherein the release compound has the structure:

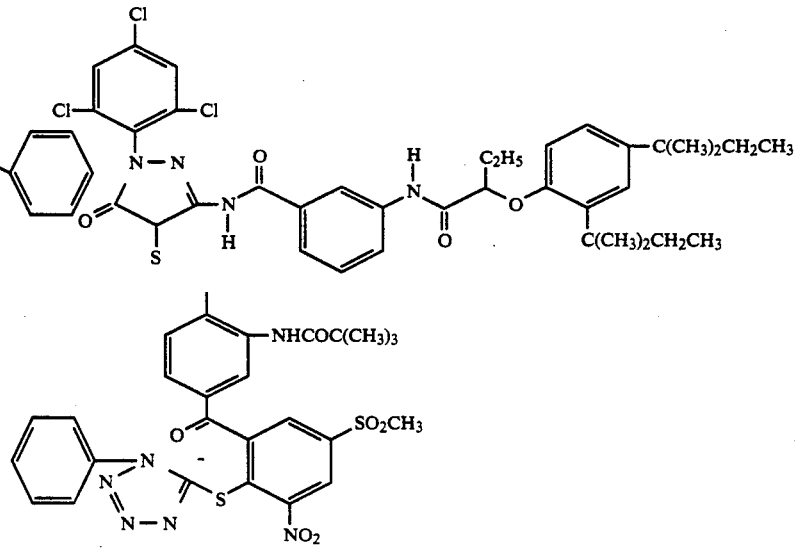

10. A process of modifying the formation of an image in a photographic element of one of claims 1 to 4, which comprises processing the element, after it has been exposed to an imagewise pattern of actinic radiation, in a processing composition containing sufficient sulfite ion to cause cleavage of the aromatic group from the photographically useful group after the aromatic group has been cleaved from the carrier and any timing group present.

* * * * *